US006020858A

United States Patent [19]

Sagisaka

[11] Patent Number: 6,020,858

[45] Date of Patent: Feb. 1, 2000

[54] FLAT-PLATE ANTENNA FOR USE WITH POLARIZED WAVES

[75] Inventor: Atsushi Sagisaka, Susono, Japan

[73] Assignee: Toyota Jidosha Kabushiki Kaisha, Toyota, Japan

[21] Appl. No.: 09/044,239

[22] Filed: Mar. 19, 1998

[30] Foreign Application Priority Data

Apr. 23, 1997 [JP] Japan ..... 9-106269

[51] Int. Cl.[7] ..... H01Q 13/10

[52] U.S. Cl. ..... 343/771; 343/770

[58] Field of Search ..... 343/770, 771, 343/777; 333/21 R, 21 A; H01Q 13/10

[56] References Cited

U.S. PATENT DOCUMENTS

| | | | |
|---|---|---|---|
| 5,173,714 | 12/1992 | Arimura et al. | 343/771 |
| 5,177,496 | 1/1993 | Arimura et al. | 343/771 |
| 5,579,019 | 11/1996 | Uematsu et al. | 343/771 |
| 5,596,336 | 1/1997 | Liu | 343/770 |

FOREIGN PATENT DOCUMENTS

| | | |
|---|---|---|
| 1-175302 | 7/1989 | Japan . |
| 5-022025 | 1/1993 | Japan . |
| 9-064637 | 3/1997 | Japan . |

*Primary Examiner*—Don Wong
*Assistant Examiner*—Tan Ho
*Attorney, Agent, or Firm*—Burns, Doane, Swecker & Mathis, LLP

[57] ABSTRACT

A plate antenna for use with polarized waves, wherein pairs of slots are formed in a parallel-plate waveguide, feeding waveguides supply mutually orthogonal TEM waves, the pairs of slots are arranged in a V-shaped pattern, adjacent slot pairs are arranged in mutually opposite directions, the antenna beam can be tilted by adjusting the space between the pairs of slots, and the pairs of slots can induce electric fields in the same direction for horizontal and vertical TEM waves. It is then possible to transmit and receive a horizontal polarized wave and a vertical polarized wave even when the antenna beam is tilted.

9 Claims, 6 Drawing Sheets

FLAT-PLATE ANTENNA FOR USE WITH POLARIZED WAVES

BACKGROUND OF THE INVENTION

1. Field of the Invention

The present invention relates to an antenna for use with polarized waves, and more particularly to an antenna for use with two orthogonal polarized waves which is provided with a tilting function.

2. Related Art

An antenna for use with two polarized waves has been developed which can transmit and receive two orthogonal polarized waves, such as a horizontally polarized wave along with a vertically polarized wave.

As an example, Japanese Patent Laid Open No. Hei 5-22025 discloses a structure of a parallel-plate slot antenna for use with two polarized waves. This antenna propagates radio waves in two orthogonal directions (horizontal and vertical directions in the plane of the paper) in the parallel-plate slot antenna, and radiates two polarized waves. More specifically, a pair of slots for radiating a horizontally-polarized wave and a pair of horizontal slots for radiating a vertically-polarized wave are formed in the upper metal sheet. The horizontally-polarized-wave radiating slots are coupled with a wave traveling in the horizontal direction in the parallel-plate waveguide, while the vertically-polarized-wave radiating slots are coupled with a wave traveling in the vertical direction in the parallel-plate waveguide.

By providing a plate antenna with two pairs of orthogonal slots, it is possible to transmit and receive both a horizontally-polarized wave and a vertically-polarized wave. However, when such a plate antenna is mounted on a specified flat surface (the roof for example) of a vehicle and used as a CS (communications satellite) antenna, it is necessary to tilt the beam from the plate antenna to the direction of the CS, but this is not possible with such an antenna.

FIGS. 8A and 8B show the relationship between the structure of the conventional plate antenna and the traveling directions of two orthogonal TEM waves and the beam tilting directions. FIG. 8A shows a case of a TEM wave traveling in the horizontal direction (left-right direction in the diagram), while FIG. 8B shows the case of the TEM wave traveling in the vertical direction (up-down direction). In FIGS. 8A and 8B, reference numeral 100 denotes a pair of slots for horizontally-polarized-wave radiation, and 200 denotes a pair of slots for vertically-polarized-wave radiation. In FIG. 8A, the pair of horizontally-polarized-wave radiating slots 100 are coupled with the horizontal TEM wave, so that an electric field E occurs in the direction as shown, Therefore, when the plate antenna is tilted in the traveling direction of the wave, the radiation is vertically polarized in the direction of this electric field E. On the other hand, in FIG. 8B, the pair of vertically-polarized-wave radiating slots 200 are coupled with the vertical TEM wave, so that an electric field E occurs in the direction as shown. Therefore, when the plate antenna is tilted in the direction of the wave, the radiated field is vertically polarized in the same way as in the case of FIG. 8A. In the conventional plate antenna, only electric field vectors parallel to the traveling direction of the TEM wave are produced, so that electric field vectors in two directions are produced. Therefore, only vertically polarized waves can be transmitted and received by tilting the plate antenna, and two polarized waves cannot be handled by a conventional plate antenna, which is a significant problem.

The present invention has been made to solve the problems with the art as explained above and has an object of providing a plate antenna which can handle two polarized waves and can also be tilted.

SUMMARY OF THE INVENTION

According to the present invention, in order to achieve the above object, there is provided an antenna for use with two polarized waves in transmitting and receiving two orthogonal polarized waves comprising pairs of slots respectively inclined at specified degrees with respect to two orthogonal TEM waves traveling in a flat waveguide and producing electric vectors in directions the same as the directions of the two TEM waves. By producing electric field vectors in the same directions as the mutually orthogonal TEM waves (horizontal and vertical directions, for example), both horizontally and vertically polarized waves can be produced by selectively tilting the antenna to the traveling directions of two TEM waves.

According to a first aspect of the present invention, the pair of slots are arranged in a wedge-shaped pattern. By this arrangement, an electric field in one direction can be obtained easily with two orthogonal TEM waves.

According to another aspect of the present invention, the slot located on the feeding side is made shorter than the other slot. The slot on the current feeding side, having a larger current component than the other slot, therefore produces a larger electric field. By using a shorter slot on the feeding side, the magnitudes of the fields produced at both slots can be made equal, and the composite field vector of the pair of slots can be turned to a desired direction.

According to yet another aspect of the present invention, the pair of adjacent slots are arranged in mutually opposite positions. When the slot on the feeding side is shorter, the electric field produced at this slot pair differs in magnitude with the respective TEM waves, and the composite electric field vector tilts. A countermeasure for this is to arrange an adjacent slot pair in the opposite direction. If a slot pair is arranged in a V-shaped pattern, an adjacent slot pair is arranged in an inverted V-shaped pattern, by which arrangement the tilt of the composite electric field vector is set in the opposite direction, so that the tilting of the two composite electric field vectors of a given slot pair and an adjacent slot pair can be mutually cancelled.

DESCRIPTION OF PREFERRED EMBODIMENTS

Embodiments of the present invention will be described with reference to the accompanying drawings.

Figure 1A:
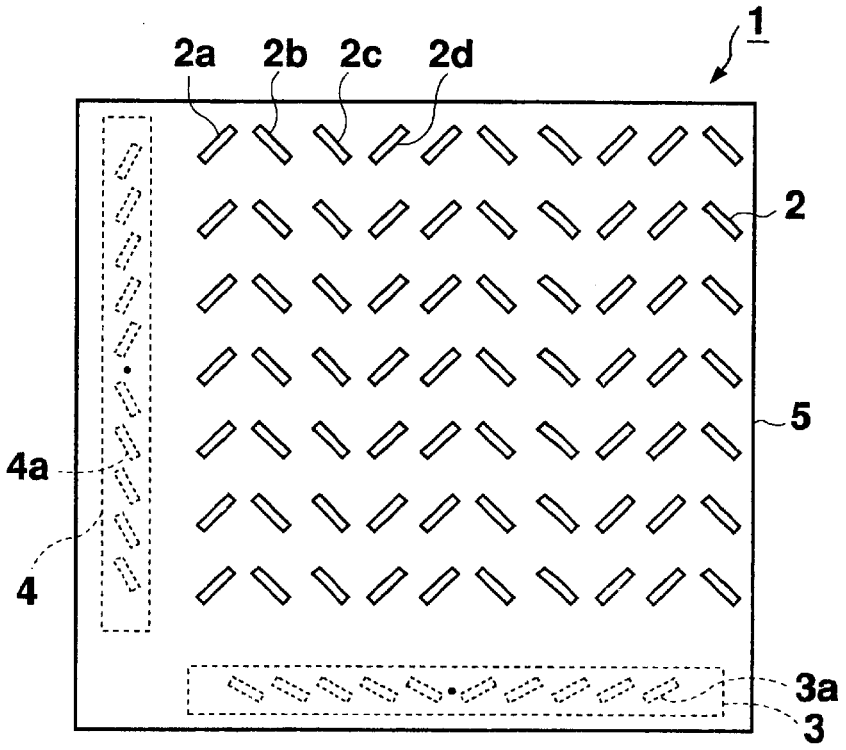
FIG. 1A is a plan view of a plate antenna according to the present invention.
Figure 1B:
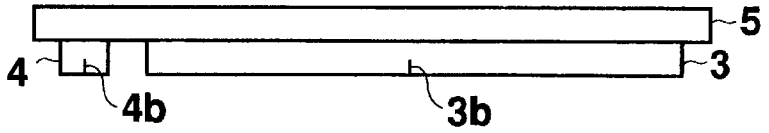
FIG. 1B is a side view of a plate antenna according to the present invention.
Figure 1C:
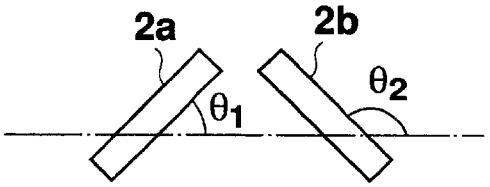
FIG. 1C is a partial enlarged view of slot pairs shown in FIG. 1A.

FIGS. 1A, 1B, and 1C show the structure of the plate antenna in an embodiment of the present invention, with FIG. 1A being a plan view, FIG. 1B being a side view, and FIG. 1C being a partial enlarged view. In a parallel-plate waveguide 5 filled with a dielectric with a specified permittivity (specific permittivity $\epsilon r$), feeding waveguides 3, 4 are provided so as to lie at right angles to each other. In the feeding waveguide 3, there are provided feeding slots and a probe 3*b* to generate a TEM wave of a wavelength $\lambda g$ [$\lambda g$ $(=\lambda/(\epsilon r)^{0.5})<\lambda$, relative to a wavelength $\lambda$ in a free space] traveling in the vertical direction (up-down direction in the plane of the paper) in the parallel-plate waveguide 5. In the feeding waveguide 4, there are provided feeding slots 4*a* and a feeding probe 4*b* to generate a TEM wave with a wavelength $\lambda g$ traveling in the horizontal direction (left-right direction in the plane of the paper). On the surface of the parallel-plate waveguide 5, a pair of slots 2 are formed, and through this pair of slots the waves which have traveled through the parallel-plate are radiated to a space (In the case of transmission; the process is reversed for reception.) This pair of slots are composed of a slot 2*a* and a slot 2*b*, or a slot 2*c* and a slot 2*d*. As shown in FIG. 1C, the angle $\theta$1 of the slot 2*a* formed with the horizontal direction is 45 degrees, and the angle $\theta$2 of the slot 2*b* formed with the horizontal direction is 135 degrees. The arrangement of the slots as described is called a wedge-shaped pattern or a V-shaped pattern in this embodiment. In other words, the arrangement of a pair of slots is such that the slots are close to each other at one end and open wide from each other at their other end. The space between the slots 2*a* and 2*b* is set as will be described below in order to let currents flow in mutually opposite directions there. (The significance of the fact that currents flow in mutually opposite directions will be described later.)

Figure 2:
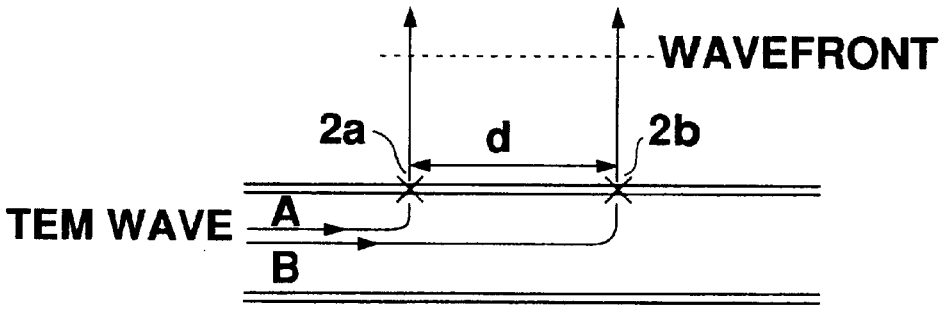
FIG. 2 is an explanatory diagram showing the relationship between the space and the phase difference between the slots when the beam is not tilted.

FIG. 2 schematically shows the relationship between the space d from the slot 2*a* to the slot 2*b* and the phase difference between TEM waves. The optical path of a TEM wave of wavelength $\lambda g$ reaching the slot 2*a* is indicated by A and the optical path of a TEM wave of wavelength $\lambda g$ reaching the slot 2*b* is indicated by B in FIG. 2. The phase difference between the optical paths A and B is expressed as 2 90 d/$\lambda g$, and if 2 $\pi d/\lambda g$ equals $\pi$, in other words, if the slot space d is $\lambda g/2$, currents flow in mutually opposite directions at the locations of the slots 2*a* and 2*b*. Note that in this embodiment, the directivity of the antenna is not set to the vertical direction but needs to be tilted by a specified angle, and therefore the slot space d is not $\lambda g/2$, but needs to be changed by an amount in accordance with the tilt angle.

Figure 3:
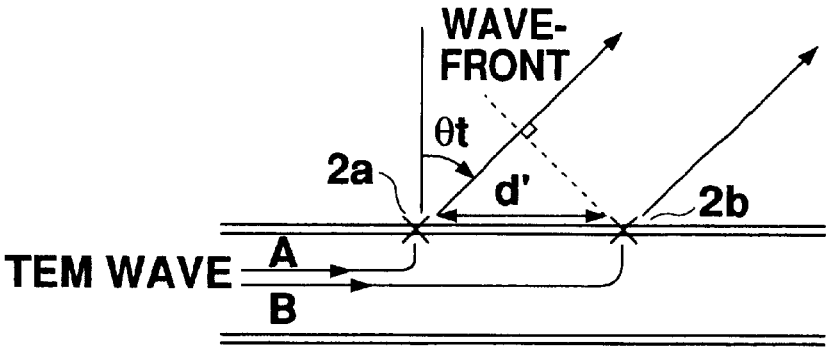
FIG. 3 is an explanatory diagram showing the relationship between the space and the phase difference between the slots when the beam is tilted.

FIG. 3 shows the relationship between the space d' from the slot 2*a* to the slot 2*b* and the phase difference between TEM waves when the antenna is tilted by a specified angle $\theta$ relative to its vertical plane. In this case, because the phase difference between the optical paths A and B is divided into a phase difference in the waveguide (wavelength $\lambda g$) and a phase difference in the free space (wavelength $\lambda$), the traveling phase difference between A and B is $2\pi d'(1/\lambda g-\sin\theta t/\lambda)$. By setting this phase difference so as to be $\pi$, the currents flow in mutually opposite directions, and for this purpose, the space d' between the slots 2*a* and 2*b* must be $$d'=\lambda\lambda g/2(\lambda-\lambda g\sin\theta t) \quad (1)$$

Figure 4:
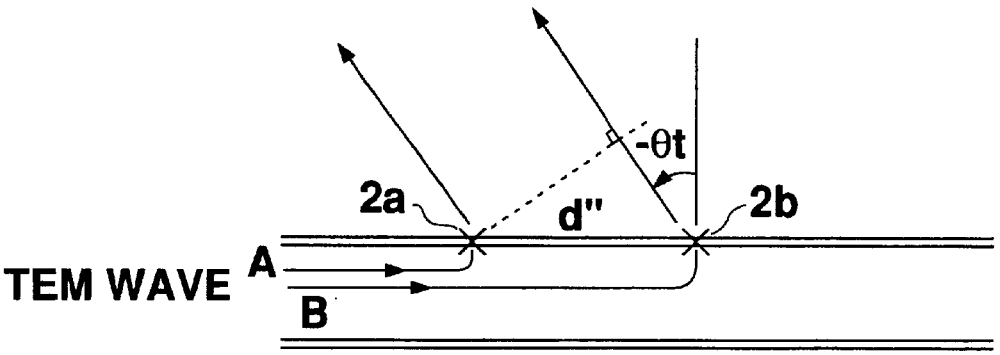
FIG. 4 is an explanatory diagram showing the relation between the space and the phase difference between the slots when the beam is tilted in the reverse direction to the direction in FIG. 3.

This applies to the space between the slots 2*c* and 2*d*. When the antenna is tilted in the opposite direction ($-\theta t$), it is necessary to set the space between the slots 2*a* and 2*b* in the same way as above. As is understandable from FIG. 4, the space between the slots 2*a* and 2*b* then must be $$d''=\lambda\lambda g/2(\lambda+\lambda g\sin\theta t) \quad (2)$$

This d" will be effective in cases where $d'>\lambda$ and a grating lobe (with a plurality of directivities) occurs.

The pair of slots 2*a* and 2*b* are arranged in a roughly wedge shaped pattern, whereas the pair of slots 2*c* and 2*d* are arranged in an inverted wedge shaped pattern, as has been described.

Figure 5:
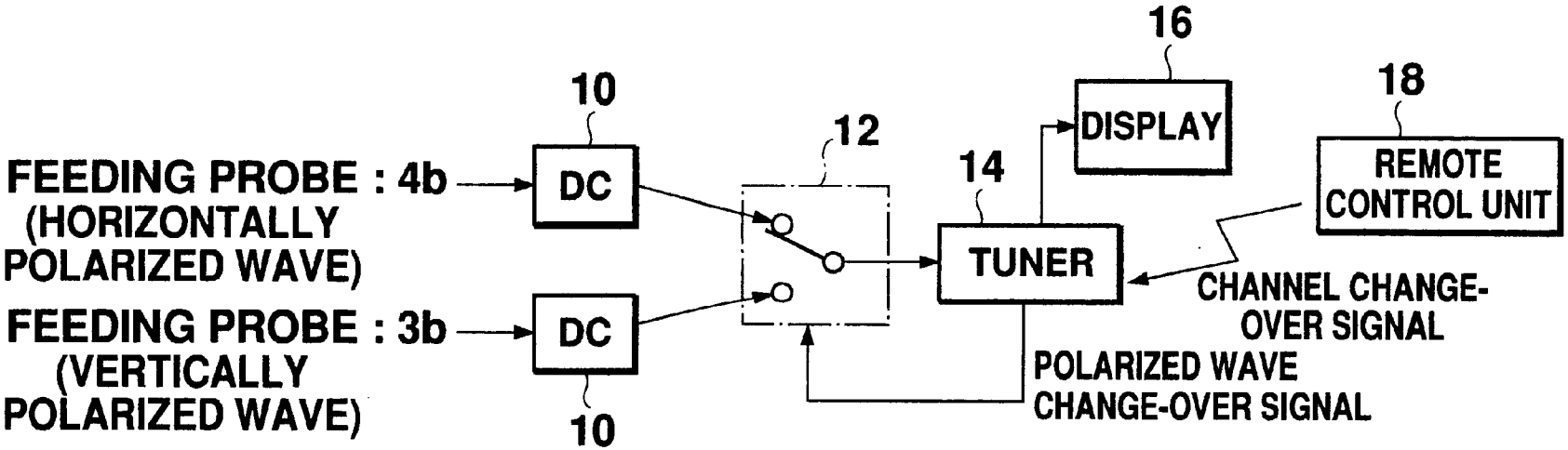
FIG. 5 is a block diagram of a CS receiving system using the plate antenna.

FIG. 5 is a general block diagram showing a mobile CS antenna formed by using a plate antenna 1 depicted in FIG. 1. A horizontally polarized wave signal from a CS received by the feeding probe 4*b*, after being converted into an intermediate frequency by a down converter (DC), is supplied to a circuit-changing switch 12. A vertically polarized wave signal from the CS received by the feeding probe 3*b*, after being converted into an intermediate frequency by a down converter (DC), is supplied to the circuit-changing switch 12. The user operates a tuner 14 to select either a horizontally or a vertically polarized wave, demodulate the received signal, and display it on a display 16. The circuit-changing switch may be operated by a remote control unit 18.

As has been described, according to this embodiment, it is possible to transmit and receive both a horizontally polarized wave and a vertically polarized wave, and to perform communication with a CS, the antenna beam can be tilted to the direction of the CS. Description will next be made of the function of the plate antenna used in this embodiment.

Figure 6A:
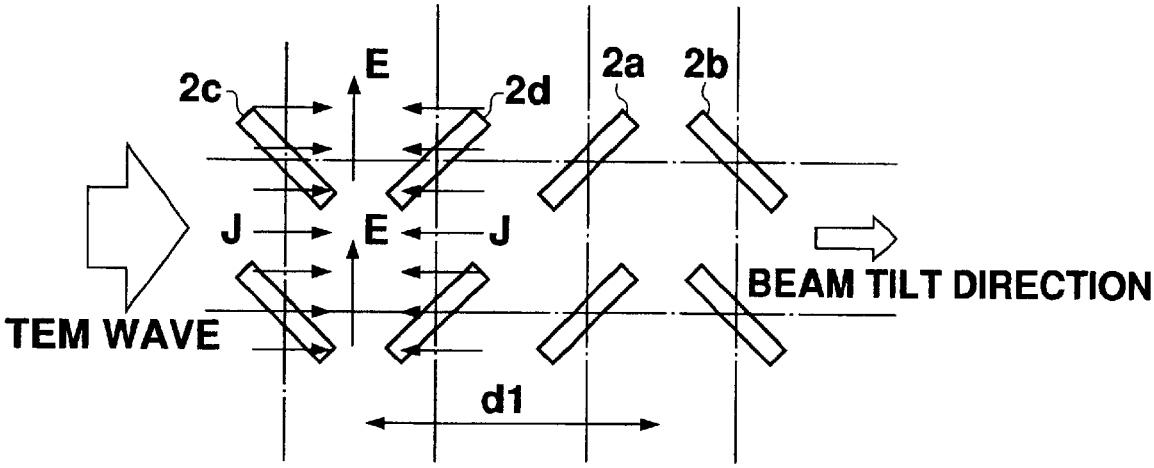
FIG. 6A is an explanatory diagram showing the direction of the electric field produced by a horizontal TEM wave.
Figure 6B:
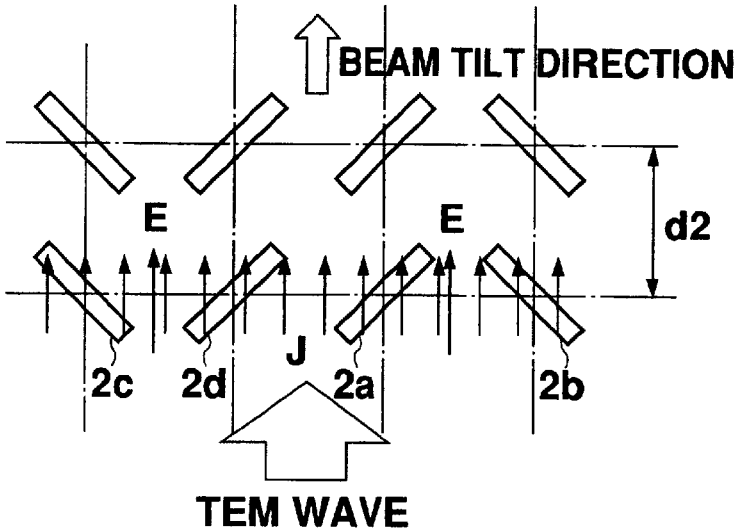
FIG. 6B is an explanatory diagram showing the direction of the electric field produced by a vertical TEM wave.

FIGS. 6A and 6B show the relationships of the pairs of slots of the plate antenna according to this embodiment with the traveling directions of two TEM waves orthogonal to each other, the electric fields produced, and the beam tilt directions. FIG. 6A shows a case where a TEM wave in the horizontal direction (left-right direction in the plane of the paper) traveling out of the feeding waveguide 4, and FIG. 6B shows a case of a TEM wave in the vertical direction (up-down direction in the plane of the paper) traveling out of the feeding waveguide 3. As illustrated in FIG. 6A, a current J flows along the wall of the waveguide in which the horizontal TEM wave is traveling. The space between the slot 2*c* and the slot 2*d*, as has been described, is $$d'=\lambda\lambda g/2(\lambda-\lambda g\sin\theta t) \quad (3)$$

or $$d''=\lambda\lambda g/2(\lambda+\lambda g\sin\theta t) \quad (4)$$

Thus, a current at the position of the slot 2*c* and a current at the position of the slot 2*d* flow in mutually opposite directions. When currents flow in mutually opposite directions, a composite electric field of the electric field induced at the slot 2*c* and the electric field induced at the slot 2*d*, in other words, electric field E, is produced by the pairs of slots in the vertical direction (up-down direction in the plane of the paper) as illustrated. This vertical direction of the electric field E is orthogonal to the traveling direction of the TEM wave. Therefore, when the space d1 between the two adjacent pairs of slots (one pair of slots 2*a* and 2*b* and the other pair of slots 2*c* and 2*d*) is adjusted and the beam is tilted to the traveling direction of the TEM wave (in FIG. 6A, the beam is tilted from the direction normal to the plane of the paper to the arrow of the beam tilt direction), the beam tilt direction and the direction of the field E are orthogonal to each other, so that the radiation is horizontally polarized.

On the other hand, in FIG. 6B, a current J flows as illustrated, in the direction along the wall of the waveguide in which a vertical TEM wave is traveling. A composite electric field of an electric field produced by the current flowing at the slot 2*c* and the current flowing at the slot 2*d*, or to put it differently, the electric field E produced by the pairs of slots, occurs in the vertical direction (up-down direction in the plane of the paper) as illustrated, and this electric field E is in the same direction as that in FIG. 6A. When the space between the adjacent pairs of slots is adjusted and the beam is tilted to the traveling direction of the TEM wave, the beam tilt direction and the electric field E are parallel with each other, and radiation is vertically polarized.

According to this embodiment of the present invention, the electric fields in the same direction can be produced by pairs of slots 2 inclined with respect to the horizontal TEM wave and the vertical TEM wave (in FIG. 1C, inclined at 45 degrees and 135 degrees to horizontal), and, even when the plate antenna is tilted to the direction of a CS, it is possible to transmit and receive a horizontally polarized wave and a vertically polarized wave.

In FIGS. 1A, 1B, and 1C, a pair of slots 2*a* and 2*b* and a pair of slots 2*c* and 2*d* are arranged in mutually opposite directions, in order to give consideration to the positional relation between the slots and the feeding waveguides 3, 4, as will be described in more detail below.

Figure 7A:
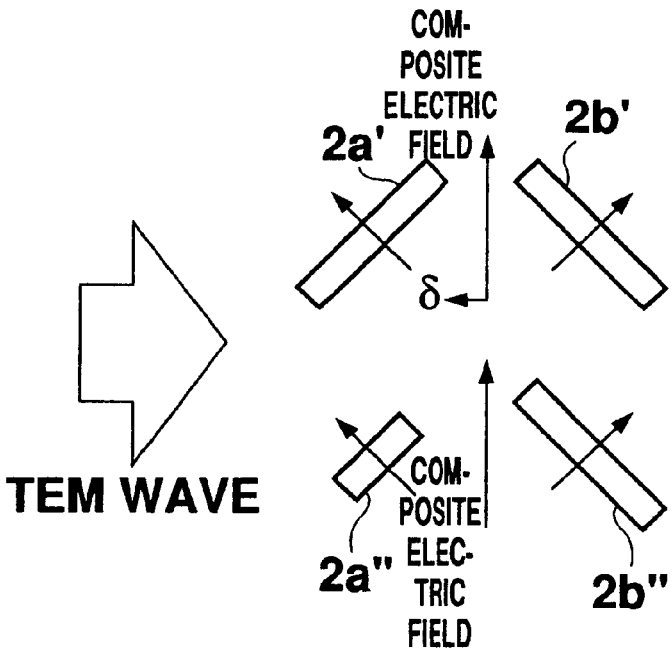
FIG. 7A is an explanatory diagram showing orthogonal polarized wave components produced by a horizontal TEM wave.

FIG. 7A shows a case of a TEM wave traveling in the horizontal direction (horizontal polarization), in which a composite electric field is produced by a pair of slots 2*a* and 2*b*. Assuming the slots 2*a* and 2*b* of the slot pair 2 are of the same length, the slot 2*a*, being closer to the feeding waveguide 4 than the slot 2*b*, has a greater induced electric field than slot 2*b* (in FIG. 7A, a pair of slots of the same length are designated as a slot 2*a′* and a slot 2*b′*). Therefore, the composite electric field also has a cross-polarization component δ and tilts, which is not desirable. As a countermeasure, the slot 2*a* closer to the feeding waveguide 4 is made shorter than the slot 2*b* (in FIG. 7A, the slots having different lengths are designated as the slot 2*a″* and the slot 2*b″*), the electric field induced at the slot 2*a″* and the electric field induced at the slot 2*b″* are made equal in magnitude, the cross-polarization component δ is thereby eliminated, and the tilt of the composite electric field E is also eliminated. In a specific example, the slot 2*a″* may be made 9mm and the slot 2*b″* made 12 mm.

Figure 7B:
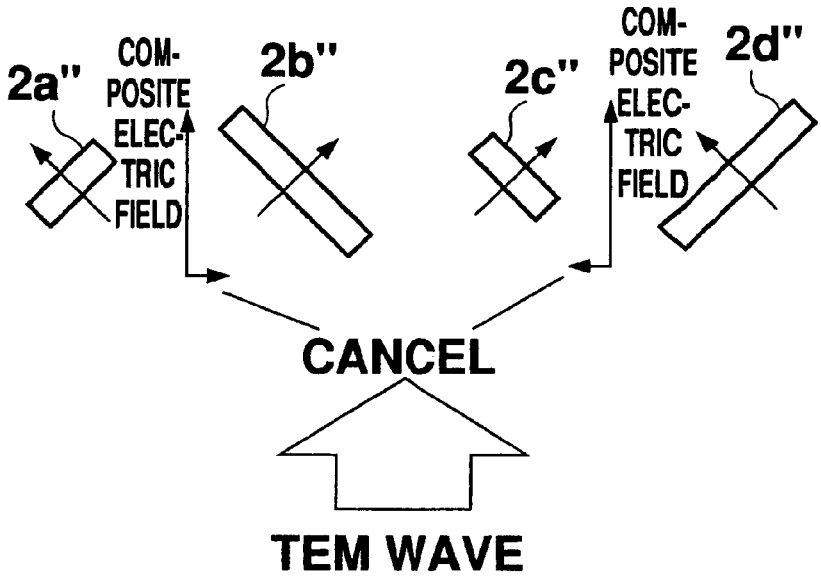
FIG. 7B is an explanatory diagram showing orthogonal polarized wave components produced in mutually opposite directions by a vertical TEM wave.
Figure 8A:
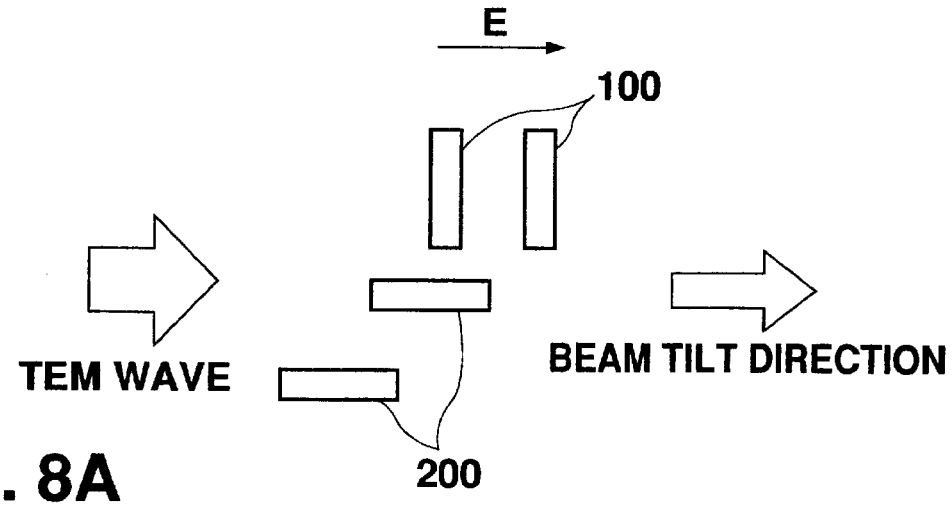
Fig. 8A PRIOR ART
FIG. 8A is an explanatory diagram showing the direction of the electric field produced by a horizontal TEM wave in the prior art.
Figure 8B:
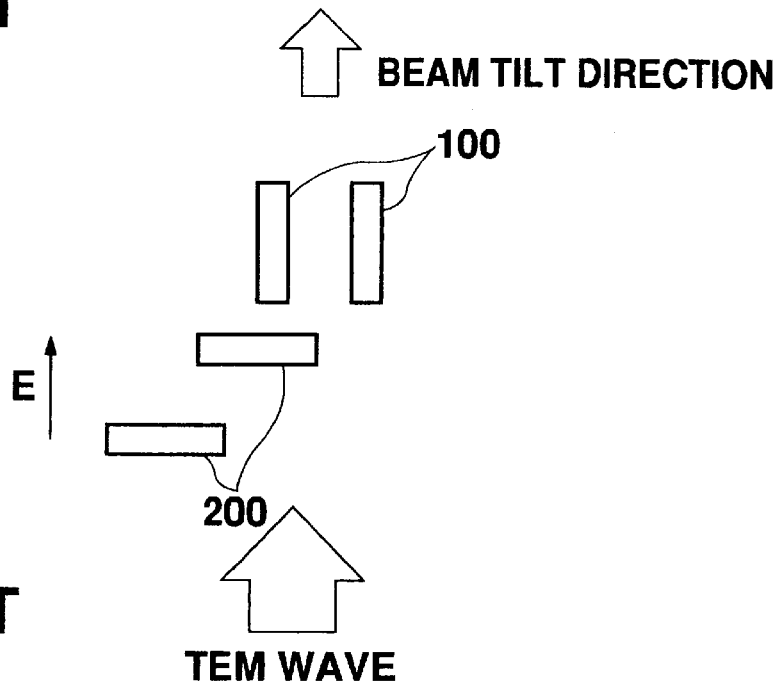
Fig. 8B PRIOR ART
FIG. 8B is an explanatory diagram showing the direction of the electric field produced by a vertical TEN wave in the prior art.

However, shortening the length of the slot located closer to the feeding side gives rise to a problem in the case of a TEM wave traveling in the vertical direction (in vertical polarization). More specifically, the slots of the slot pair in question are at the same distance from the feeding waveguide 3, so that the electric field induced at the shorter slot is smaller than that induced at the longer slot, and a cross-polarization component δ occurs in composite electric field. Therefore, as shown in FIG. 7B, by arranging the two adjacent slot pairs of 2*a*Δ, 2*b″* and 2*c″*, 2*d″* in mutually opposite directions (in a V-shaped pattern and an inverted V-shaped pattern), the cross-polarization components δ which occur at the respective slot pairs are directed in opposite directions and cancel each other to thereby eliminate the cross-polarization components δ.

By using a shorter slot at a position closer to the feeding side for horizontal polarization than the other slot of the slot pair, the cross-polarization component caused by a difference in distance from the feeding point can be eliminated, and, by arranging the adjacent slot pairs in mutually opposite directions, the cross-polarization components that occur in the vertically polarized wave can be removed. Moreover, by arranging the adjacent slot pairs in mutually opposite directions, the space between the antenna elements (slot pairs) can be made shorter than in the case where the slots are otherwise arranged, and there is an effect of suppressing the so-called grading lobe in which a plurality of directivities occur.

It should be remembered that the angles of the slots of the slot pairs mentioned above were selected for the purpose of illustrating examples, and may be varied as necessary.

For example, in the above embodiment, the angles of the slots 2*a* and 2*b* (or the slots 2*c* and 2*d*) formed with a horizontal direction were θ1=45 degrees and θ2=135 degrees, but those angles may also be θ1=30 degrees and θ2=150 degrees, so long as the optional θ1 and θ2 fulfill the requirement that θ1+θ2=180 degrees. Because the vertical composite electric field becomes smaller at a greater angle of θ1, the number of slot pairs in the vertical direction should preferably be increased with an increase in θ1. In this case, the shape of the parallel-plate waveguide should preferably be a longer rectangle than a square.

Any degrees of θ1 and θ2 meeting θ1+θ2>180 degrees or θ1+θ2<180 degrees may be used. In this case, the field intensity differs at the respective slots of the slot pairs, so that it is necessary to adjust the slot space to obtain uniform field intensity.

In the above embodiments, the feeding waveguides 3, 4 are provided at the edge portions (the lower edge and the left-side edge in FIG. 1A) of the parallel-plate waveguide 5, but may be set at optional positions so long as those waveguides are orthogonal to each other. For example, the feeding waveguides 3, 4 may be arranged in a cross pattern such that they intersect in the center of the parallel-plate waveguide 5.

The present invention produces an electric field in one direction for two TEM waves by providing slot pairs in the waveguide of a plate antenna and arranging the individual slots of the slot pairs with respect to mutually orthogonal TEM waves. Therefore, in addition to a wedge-shaped arrangement, other shapes and positional relationships of the slot pairs that can produce electric fields in the same direction are included in the technical scope of the present invention.

As has been described, according to the present invention, a plate antenna is provided which can handle two polarized waves and which can be tilted, and therefore may be used in various applications such as a CS antenna mounted on a vehicle.

What is claimed is:

1. A plate antenna for use with two polarized waves in transmitting and receiving two orthogonal polarized waves, comprising:

a plate waveguide; and a plurality of adjacent pairs of slots, each pair of slots inclined at specified degrees with respect to two orthogonal TEM waves traveling in said plate waveguide, and which produces electric field vectors in the same direction for said two TEM waves;

wherein said adjacent pairs of said slots are arranged in mutually opposite directions.

2. A plate antenna according to claim 1, wherein said pair of slots are arranged in a wedge-shaped pattern.

3. A plate antenna according to claim 1, wherein said pair of slots are arranged in a V-shaped pattern.

4. A plate antenna according to claim 1, wherein a space between two slots constituting said pair of slots is a space where currents flow in opposite directions at the locations of said two slots.

5. A plate antenna according to claim 1, further comprising:

two orthogonal power feeding means for producing said two TEM waves; and a circuit-changing switch for selectively changing over said two power feeding means.

6. A plate antenna for use with orthogonal two polarized waves in transmitting and receiving two orthogonal polarized waves, comprising:

a plate waveguide; and a plurality of adjacent pairs of slots, each pair of slots respectively inclined at specified degrees with respect to two orthogonal TEM waves traveling in said plate waveguide, which produces electric field vectors in the same direction for said two TEM waves, wherein said pair of slots are arranged in a wedge-shaped pattern, the slot located closer to a feeding side is shorter in length, said adjacent pairs of said slots are arranged in mutually opposite directions, and a space between two slots constituting said pair of slots is a space where currents flow in opposite directions at the locations of said two slots.

7. A plate antenna according to claim 6, further comprising:

two orthogonal power feeding means for producing said two TEM waves; and a circuit-changing switch for selectively changing over said two power feeding means.

8. A plate antenna for use with two polarized waves in transmitting and receiving two orthogonal polarized waves, comprising:

a plate waveguide; and a pair of slots inclined at specified degrees with respect to two orthogonal TEM waves traveling in said plate waveguide, and which produces electric field vectors in the same direction for said two TEM waves;

wherein of said pair of slots, a slot located closer to a feeding side is shorter in length than the other slot.

9. A plate antenna for use with two polarized waves in transmitting and receiving two orthogonal polarized waves, comprising:

a plate waveguide;

feeding waveguides disposed at right angles with respect to each other and disposed along edge portions of said plate waveguide, said feeding waveguides generating two respective TEM waves which propagate through said plate waveguide in orthogonal directions with respect to each other; and a pair of slots inclined at specified degrees to form a wedge-shaped pattern with respect to said two orthogonal TEM waves traveling in said plate waveguide, and which produces electric field vectors in the same direction for said two TEM waves.

* * * * *